US006093061A

United States Patent [19]

Varsik et al.

[11] Patent Number: 6,093,061

[45] Date of Patent: Jul. 25, 2000

[54] ELECTRICAL CONNECTOR HAVING TERMINAL INSERT SUBASSEMBLY

[75] Inventors: Laura L. Varsik, Clemmons; Ronald D. Sizemore, Germanton; Randy G. Simmons, Lewisville, all of N.C.

[73] Assignee: The Whitaker Corporation, Wilmington, Del.

[21] Appl. No.: 09/127,321

[22] Filed: Jul. 31, 1998

[51] Int. Cl.[7] ..... H01R 13/502

[52] U.S. Cl. ..... 439/701; 439/632

[58] Field of Search ..... 439/701, 710, 439/712, 713, 717, 630, 632

[56] References Cited

U.S. PATENT DOCUMENTS

| | | | |
|---|---|---|---|
| 4,655,515 | 4/1987 | Hamsher, Jr. et al. | 439/701 |
| 4,808,115 | 2/1989 | Norton et al. | 439/609 |
| 5,288,251 | 2/1994 | Sumida | 439/701 |
| 5,320,555 | 6/1994 | Okabe | 439/701 |
| 5,364,291 | 11/1994 | Hashiguchi | 439/607 |
| 5,511,984 | 4/1996 | Olson et al. | 439/701 |
| 5,597,326 | 1/1997 | DeLessert et al. | 439/608 |
| 5,924,876 | 7/1999 | Beamenderfer et al. | 439/79 |

*Primary Examiner*—Hien Vu
*Attorney, Agent, or Firm*—Robert Kapalka

[57] ABSTRACT

An electrical connector includes a housing having a cavity which holds a pair of terminal inserts. Each of the terminal inserts includes a respective molding which holds a respective plurality of terminals. The moldings have respective latch arms which latchably secure the terminal inserts together to form a terminal insert subassembly which is inserted into the cavity as a unit. The latch arms have latch tabs which are cooperable with the housing to secure the terminal insert subassembly in the housing. The terminals in one of the terminal inserts are laterally staggered with respect to the terminals in the other of the terminal inserts.

6 Claims, 4 Drawing Sheets

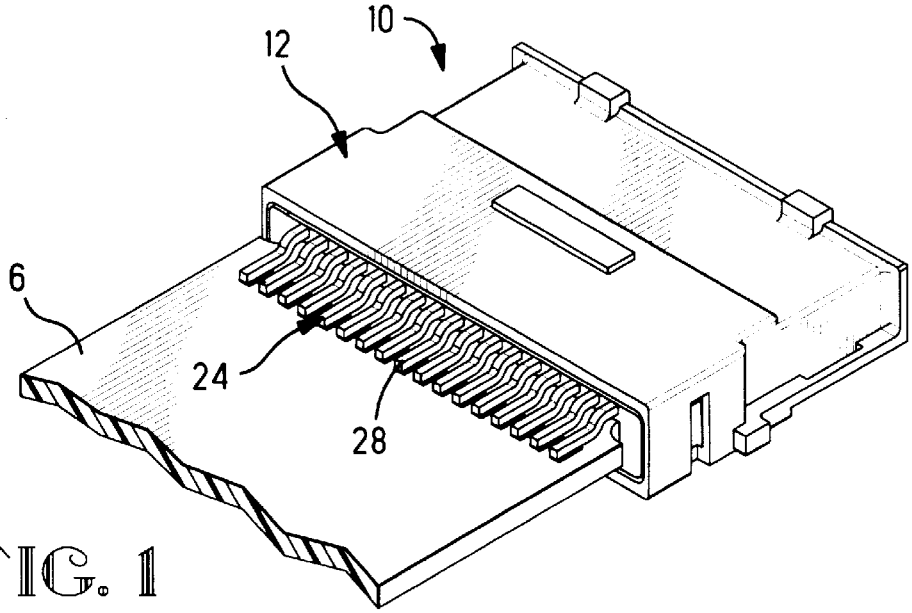
FIG. 1
FIG. 2
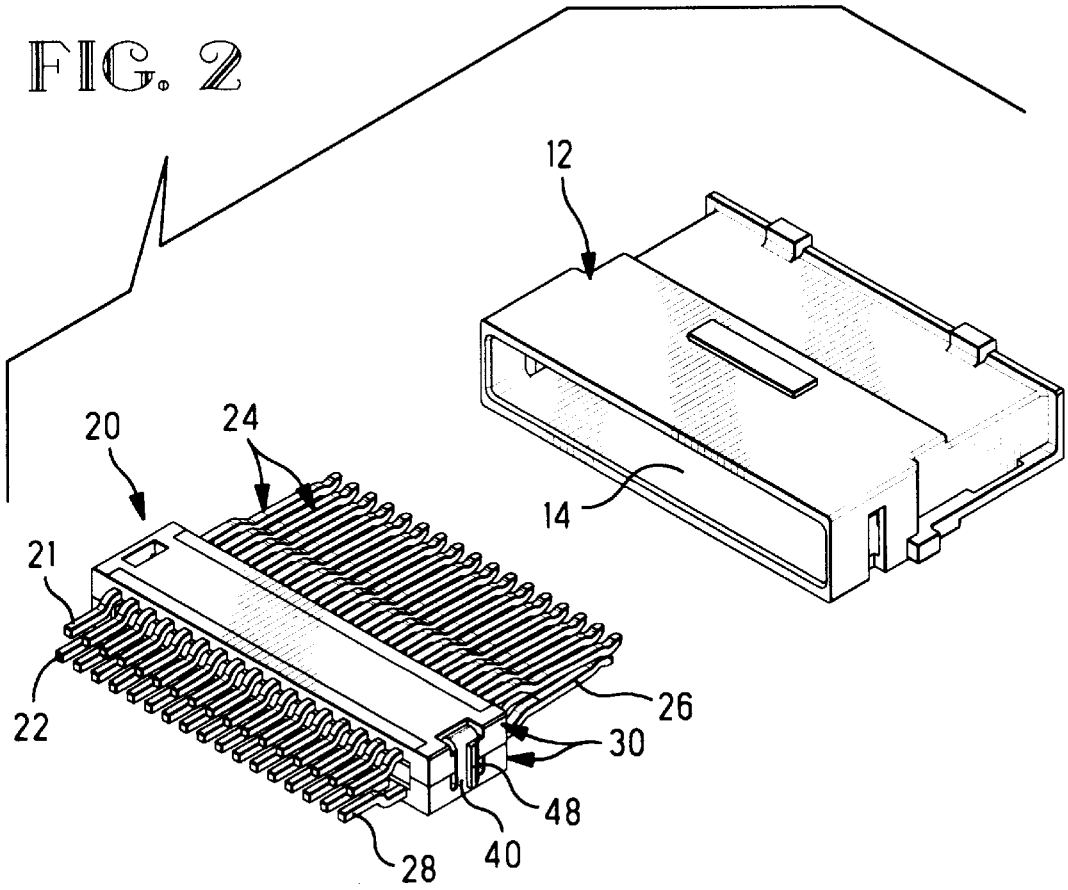

ELECTRICAL CONNECTOR HAVING TERMINAL INSERT SUBASSEMBLY

FIELD OF THE INVENTION

The invention relates to an electrical connector including a housing having a cavity which receives a terminal insert.

BACKGROUND OF THE INVENTION

An electrical connector including a housing which holds a plurality of terminals may have the terminals formed as a pre-manufactured insert. Such an insert includes a dielectric material that is molded around the terminals to hold the terminals in fixed relative positions, and exposed ends of the terminals are formed to a desired shape which is generally the final shape of the terminals in the connector. Subsequently, the insert is installed into the housing as a unit. The terminal insert eliminates the need to handle the terminals individually, and allows a plurality of terminals to be formed simultaneously to a common shape. However, the terminals in one insert generally cannot have two different shapes because tools which are used for forming one of the shapes will interfere with the terminals which must have a different shape. Further, for a connector having terminals aligned in different rows, each row of terminals must be formed as a separate insert due to difficulty in forming multiple rows of terminals in a single insert. There is a need for an improved insert which facilitates handling and forming of a plurality of terminals, especially terminals which are disposed in two different rows.

SUMMARY OF THE INVENTION

The invention is an electrical connector comprising a housing having a cavity which holds a pair of terminal inserts. Each of the terminal inserts includes a respective molding which holds a respective plurality of terminals. The pair of terminal inserts are latchably secured together for insertion into the cavity as a unit.

According to one aspect of the invention, the respective moldings are hermaphroditic.

According to another aspect, each of the moldings includes a latch arm at one end and a latch-receiving recess at an opposite end.

According to another aspect, at least one of the latch arms includes a latch tab which is cooperable with the housing for securing the pair of terminal inserts in the housing.

According to yet another aspect, the terminals in one of the terminal inserts are laterally staggered with respect to the terminals in the other of the terminal inserts.

BRIEF DESCRIPTION OF THE DRAWINGS

The invention will now be described by way of example with reference to the accompanying drawings wherein:

FIG. 1 is a top rear isometric view of an electrical connector according to the invention;

FIG. 2 is an isometric view showing a terminal insert subassembly exploded from a housing of the connector;

DETAILED DESCRIPTION OF A PREFERRED EMBODIMENT

Figure 3:
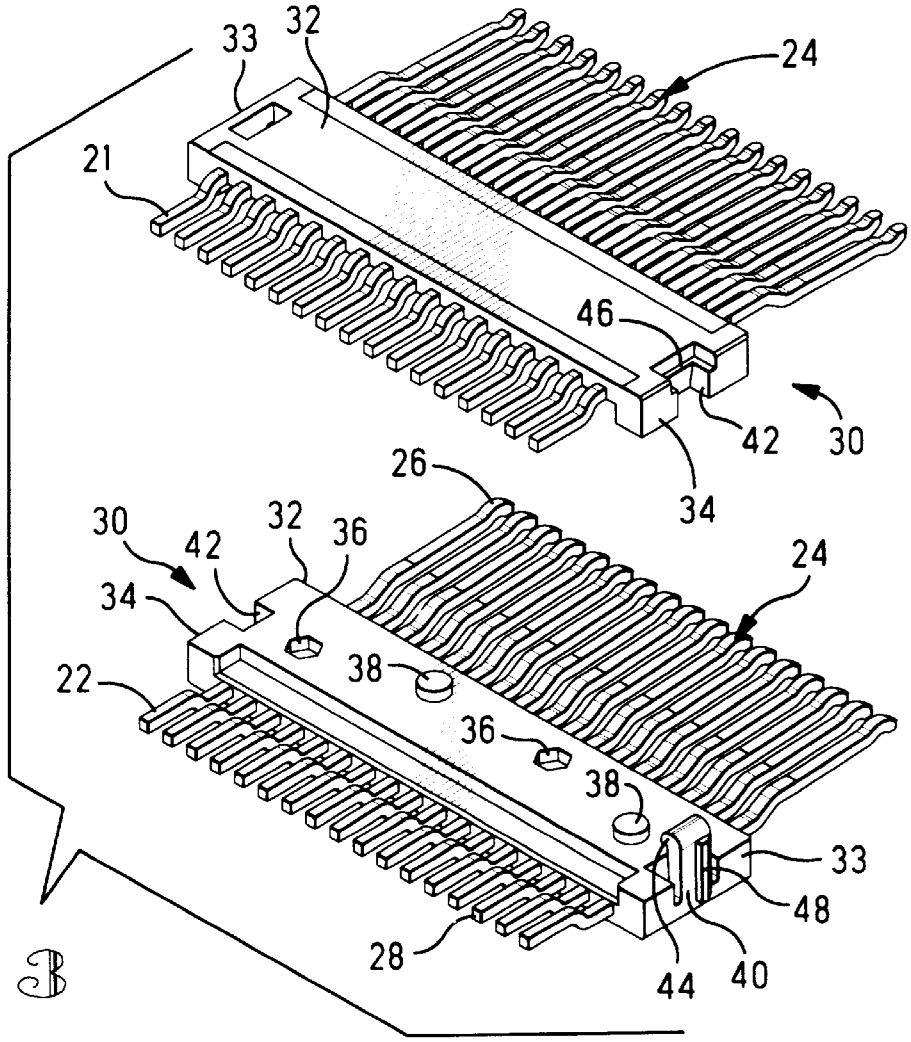
FIG. 3 is an isometric view showing a pair of terminal inserts which comprise the terminal insert subassembly.

There is shown in FIGS. 1 and 2 an electrical connector 10 comprising a housing 12 having a cavity 14 that receives a terminal insert subassembly 20 according to the invention. The terminal insert subassembly includes terminals 24 having forward mating portions 26 that are engageable with terminals of a mating electrical connector (not shown), and rearward terminating portions 28 that are engageable with conductors such as on a cable or a circuit board 6. The terminals 24 are aligned in two laterally extending rows which may be termed first row 21 and second row 22.

As shown in FIG. 3, the terminal insert subassembly 20 comprises a pair of inserts 30 each including a molding 32 which carries the terminals 24 in a respective one of the first and second rows 21, 22. As shown, the pair of inserts 30 are identical and the moldings 32 are hermaphroditic, that is, each molding is matable with an identical companion molding. However, in order to provide a connector having terminals in two rows with different shapes it may be desirable for the terminals in one of the inserts to differ in length and/or configuration from the terminals in the other insert. In such a case it is still preferable for the moldings 32 to be hermaphroditic although the terminals 24 are not identical.

Figure 4:
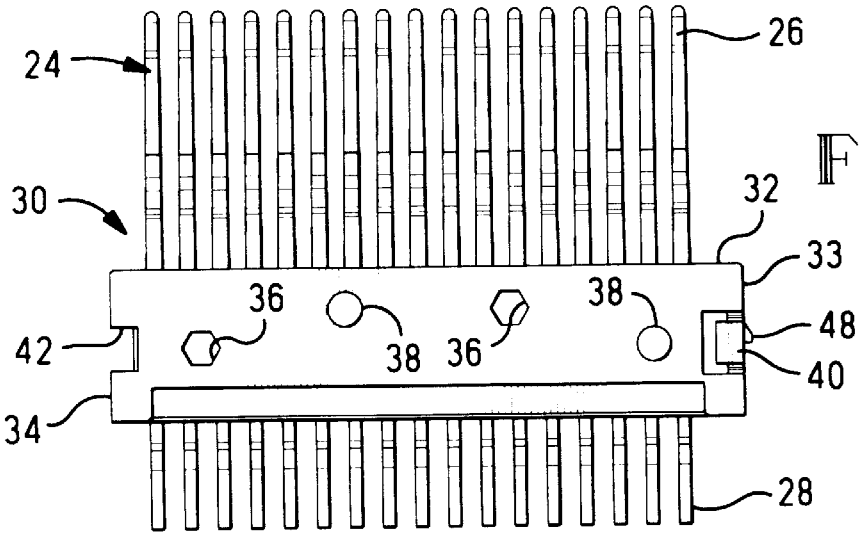
FIG. 4 is a plan view of one of the terminal inserts.

With reference to FIGS. 3 and 4, each molding 32 is formed of dielectric material which is molded around mid-portions of the terminals 24 between the forward mating portions 26 and the rearward terminating portions 28. The molding 32 extends between opposite lateral ends 33, 34 and spans the row of terminals 24. Each of the moldings 32 has a set of hexagonal apertures 36 and circular projections 38. The projections 38 of each molding are sized for a close fit within the apertures 36 of the other molding to ensure correct registration and alignment of the pair of moldings.

Figure 5:
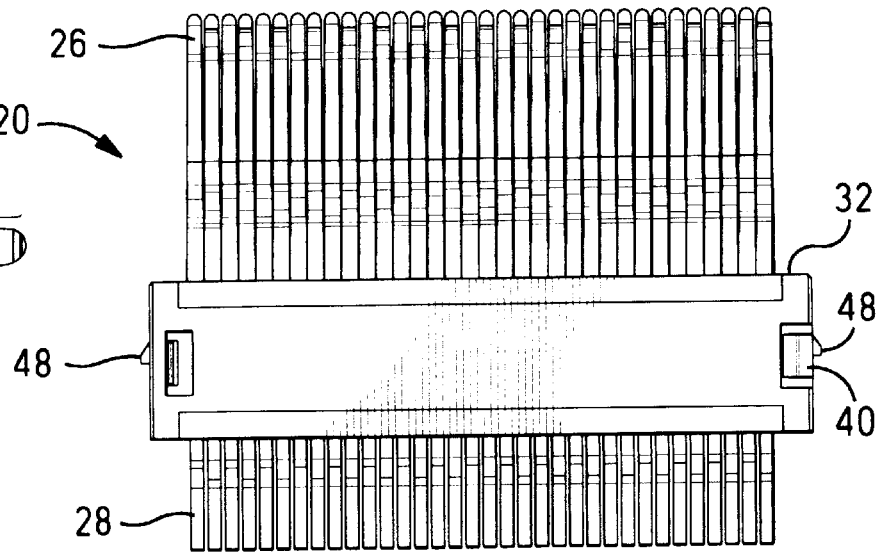
FIG. 5 is plan view of the terminal insert subassembly.

Each of the moldings 32 has a resilient latch arm 40 at the one end 33 and a latch-receiving recess 42 at the opposite end 34. The latch arm 40 of each molding is received in the latch-receiving recess 42 of the other molding. Each latch arm 40 has an inwardly extending latch tab 44 that engages behind a ledge 46 of the other molding to secure the pair of inserts together. These latched together inserts comprise the insert subassembly 20 (FIGS. 2 and 5) which is installed into the connector housing 12 as a unit.

Figure 6:
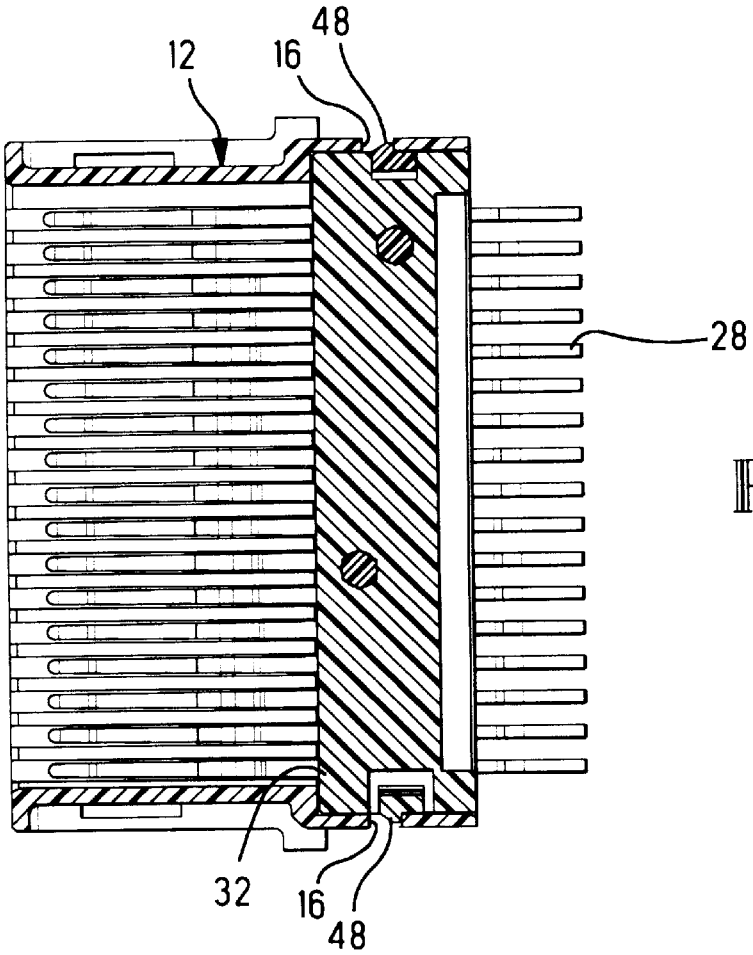
FIG. 6 is a horizontal cross-sectional view through the electrical connector.
Figure 7:
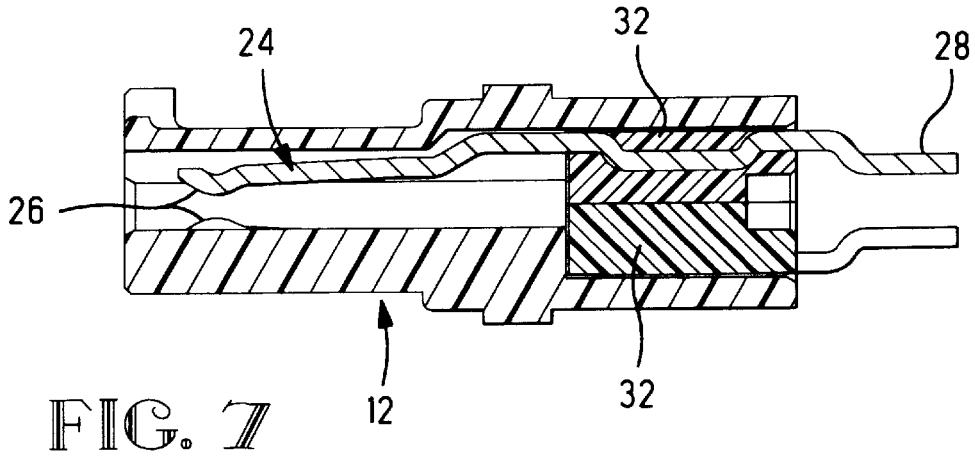
FIG. 7 is a vertical cross-sectional view through the electrical connector.

Each of the latch arms 40 has an outwardly extending latch tab 48. As best seen in FIG. 6, the terminal insert subassembly is secured in the connector housing by entry of the latch tabs 48 into apertures 16 in side walls of the housing.

Figure 8:
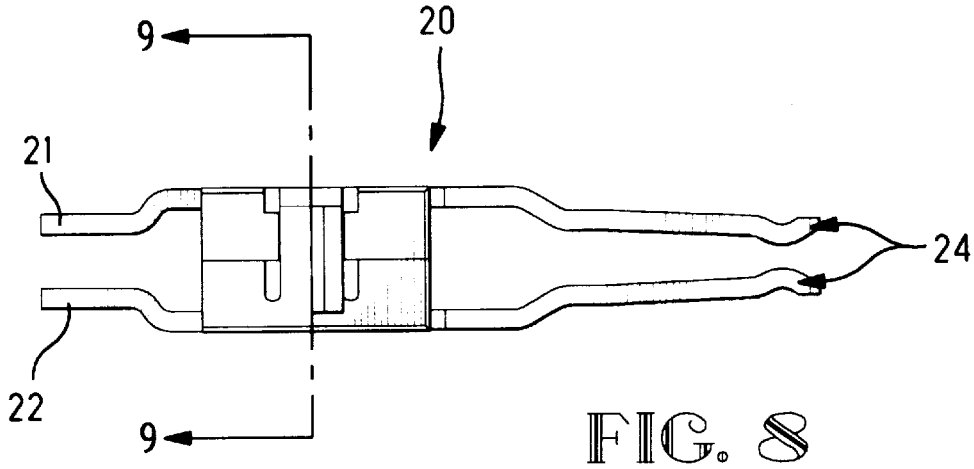
FIG. 8 is a side view of the terminal insert subassembly.
Figure 9:
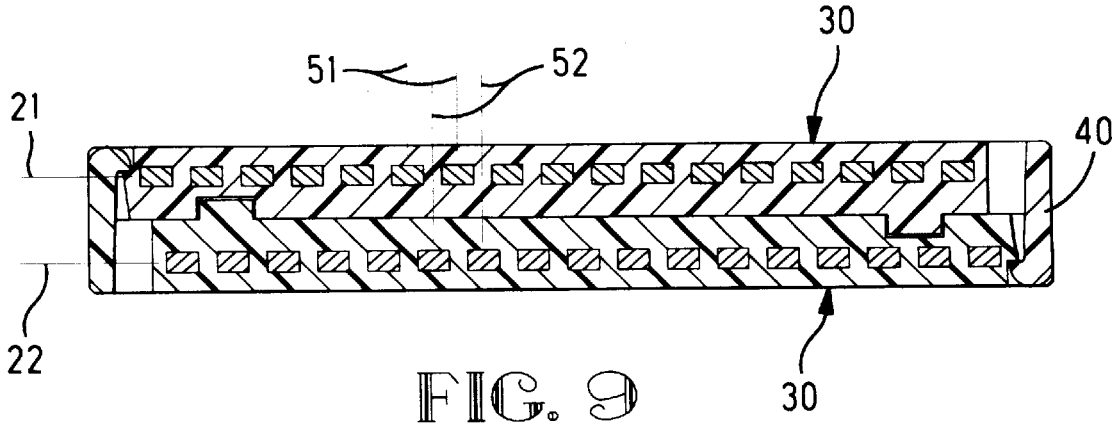
FIG. 9 is a cross-sectional view taken along line 9—9 in FIG. 8.

With reference to FIGS. 8 and 9, the terminals in one of the rows 21, 22 of the terminal insert subassembly are laterally staggered with respect to the terminals in the opposite row. That is, the terminals in rows 21, 22 are disposed on respective centerlines 51, 52, and these centerlines are interleaved one row to the other row in alternating sequence.

The invention provides an electrical connector comprising a terminal insert subassembly including a pair of terminal inserts that are latchably secured together for installation into the connector as a unit. The invention facilitates manufacture of an electrical connector having two rows of terminals because the terminals in each row can be handled as individual inserts, thereby simplifying plastic molding and terminal forming operations. Further, the pair of inserts have hermaphroditic moldings, thereby minimizing tooling and equipment costs. Also, installation of the terminal insert subassembly as a unit simplifies manufacture of the connector.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

We claim:

1. An electrical connector comprising:

a housing having a cavity which holds a pair of terminal inserts, each of the terminal inserts including a respective molding which holds a respective plurality of terminals, each of the moldings including a resilient latch arm at one end and a latch-receiving recess at an opposite end, the moldings being hermaphroditic and inverted with respect to each other, wherein the resilient latch arm of each said molding is latchably received in the latch-receiving recess of the other said molding, wherein the pair of terminal inserts are latchably secured together for insertion into the cavity as a unit, and wherein the terminals in one of the terminal inserts are laterally staggered with respect to the terminals in the other of the terminal inserts.

2. The electrical connector of claim 1 wherein at least one of the latch arms includes a latch tab which is cooperable with the housing for securing the pair of terminal inserts in the housing.

3. A terminal insert subassembly for an electrical connector comprising:

a pair of terminal inserts each including a respective molding which holds a respective plurality of terminals, each of the moldings including a resilient latch arm at one end and a latch-receiving recess at an opposite end, the moldings being hermaphroditic and inverted with respect to each other, wherein the resilient latch arm of each said molding is latchably received in the latch-receiving recess of the other said molding, wherein the pair of terminal inserts are latchably secured together for installation in the electrical connector as a unit, and wherein the terminals in one of the terminal inserts are laterally staggered with respect to the terminals in the other of the terminal inserts.

4. The terminal insert subassembly of claim 3 wherein at least one of the latch arms includes a latch tab for securing the terminal insert subassembly in the electrical connector.

5. An electrical connector comprising:

a housing having a cavity which holds a pair of terminal inserts, each of the terminal inserts including a respective molding and a respective plurality of terminals, each of the terminals extending longitudinally from a forward mating end to a rearward terminating end, the plurality of terminals being laterally spaced-apart and the molding extending laterally across the terminals, each of the moldings including a resilient latch arm at one end and a latch-receiving recess at an opposite end, the moldings being hermaphroditic and inverted with respect to each other, wherein the resilient latch arm of each said molding is latchably received in the latch-receiving recess of the other said molding, wherein the pair of terminal inserts are latchably secured together to form a terminal insert subassembly which is inserted into the cavity as a unit, and wherein the terminals in one of the terminal inserts are laterally staggered with respect to the terminals in the other of the terminal inserts.

6. The electrical connector of claim 5 wherein at least one of the latch arms includes a latch tab which is cooperable with the housing for securing the terminal insert subassembly in the housing.

* * * * *